United States Patent [19]

Shimizu

[11] 4,117,567

[45] Oct. 3, 1978

[54] DOOR CLOSER

[75] Inventor: Toyoaki Shimizu, Tokyo, Japan

[73] Assignee: Nikkey Co., Ltd., Tokyo, Japan

[21] Appl. No.: 852,813

[22] Filed: Nov. 18, 1977

[30] Foreign Application Priority Data

Oct. 8, 1977 [JP] Japan ..... 52-135553[U]

[51] Int. Cl.[2] ..... E05F 3/20; E05F 3/22

[52] U.S. Cl. ..... 16/50; 16/188; 16/189; 16/75

[58] Field of Search ..... 16/49, 71, 75, 76, 82, 16/50, 128, 180, 189

[56] References Cited

U.S. PATENT DOCUMENTS

| | | | |
|---|---|---|---|
| 217,051 | 7/1879 | Bommer | 16/188 |
| 2,493,115 | 1/1950 | Diebel | 16/76 X |
| 3,825,973 | 7/1974 | Gwozdz | 16/52 |
| 3,898,708 | 8/1975 | Gwozdz | 16/50 |
| 3,965,533 | 6/1976 | Frohlich | 16/52 |

FOREIGN PATENT DOCUMENTS

| | | | |
|---|---|---|---|
| 1,082,703 | 12/1954 | France | 16/189 |
| 412,125 | 6/1934 | United Kingdom | 16/189 |

*Primary Examiner*—Ronald Feldbaum
*Attorney, Agent, or Firm*—J. Harold Nissen

[57] ABSTRACT

A door closer comprises: first and second cylinders provided with respective hinge pieces, the cylinders being rotatable with respect to each other about one and the same axis and being in contact with each other in the axial direction thereof; a support shaft inserted into the two cylinders substantially over the entire length thereof, one end portion of the support shaft being non-rotatably secured to the end portion of the second cylinder while the other end portion thereof being rotatably supported in the first cylinder; an intermediate rotary cylinder member provided rotatably with respect to the support shaft and the first cylinder between one end portion of the support shaft and the inner wall of the first cylinder; and a coil spring surrounding substantially the entire length of the support shaft in such a manner that both end portions thereof are non-rotatably secured to the intermediate rotary cylinder member and the lower end portion of the second cylinder, respectively. Grooves are formed at predetermined positions on the inner wall of the upper end portion of the first cylinder, the outer wall of the upper end portion of the support shaft, and the inner wall of the intermediate rotary cylinder member in such a manner that the grooves form two holes as the first and second cylinders are rotated into which two pins are detachably inserted.

8 Claims, 13 Drawing Figures

DOOR CLOSER

BACKGROUND OF THE INVENTION

This invention relates to door closers operating to automatically close an opened door, and more particularly to a door closer with hinge pieces in which a restoring coil spring is incorporated in hollow cylinders with hinge pieces over the entire length of the hollow cylinders.

In general, in a door closer of this type, the restoring torque of the restoring spring is reduced as the door opening degree is decreased when the door is closed, and it is necessary to allow a door locking means such as a latch to operate immediately before the door is completely closed. Accordingly, it is necessary that when the door opening degree becomes small the restoring torque is continuously applied to the door until the door locking means such as a latch is positively operated. Therefore, it is preferable that the door closer is so designed that even when the door is completely closed, that is, the door opening degree becomes zero, a present torque is applied to the door to a certain extent so that when the door opening degree becomes small, the present torque is added to the torque corresponding to that door opening degree.

In such a door closer, or in a conventional door closer constructed as shown in FIG. 1, a cylinder 103 having a support shaft 102 is fixedly fitted into a hollow cylinder 101 with a hinge piece 100', and the head section 104 of the cylinder 103 is protruded outside the cylinder 101. A hollow cylinder 105 with a hinge piece 100 is rotatably engaged with the head section 104. The support shaft 102 is surrounded by a coil spring 107 both end portions of which are secured to the head section 104 of the cylinder 103 and a cover 108 mounted on the hollow cylinder 105, respectively. The support shaft 102 is rotatably engaged with the cover 108. When, after the hinge piece of the hollow cylinder 101 is mounted on a fixing member such as a pillar and the hinge piece 100 of the hollow cylinder 105 is secured to a door, the door is opened, a restoring force is applied to the door by the elastic force of the coil spring 107. In this case, in general, a damper device having a hydraulic mechanism is separately provided so as to damp the restoring force.

In the above-described door closer, the hollow cylinder 101 is coupled to the hollow cylinder 105 through the head section 104 of the cylinder 103, and therefore the coil spring 107 utilizes only the limited internal space in the hollow cylinder 105. Accordingly, the length of the coil spring 107 employed in this limited internal space is necessarily short. It should be noted that the spring constant of a torsion coil spring is inversely proportional to the length thereof. Accordingly, in the conventional door closer, the spring constant of the coil spring is necessarily large. This means that as the door opening degree increases, the restoring torque is abruptly increased. If the door closer is so designed that with a large spring constant a great restoring force is obtained when the door opening degree is small, an extremely great restoring force is effected when the door is widely opened. This may obstruct the opening and closing operation of the door in practice. Thus, heretofore it is difficult to design the door closer so that a great restoring torque is effected when the door opening degree is small.

This difficulty may be overcome by decreasing the spring constant. Accordingly, it is a solution to this problem to increase the spring accommodating capacity as much as possible minimizing the number of components such as steel shafts or bearings giving a mechanical strength to the door closer. However, in this case, another problem pertaining to the durability attributed to a torsion stress with respect to the steel shafts is newly provided. This contradictory condition has not been overcome yet. Further, under the above-described conditions, we have frequently found that the door locking means such as a latch is not operated completely and positively when the door is closed.

The mounting of the door closer applied with the preset torque is carried out after the hinge pieces are opened, and therefore the preset torque is added to the restoring torque corresponding to the opening degree of the hinge pieces. Accordingly, the mounting of the door closer must be carried out while the hinge pieces is being opened with a considerably great force against the great torque which is the sum of the preset torque and the restoring torque. Accordingly, the door closer mounting work is rather troublesome and difficult; that is, it must be done by a skilled person with a great care. Thus, the conventional door closer suffers from a disadvantage that the work efficiency is very low. In addition, the solution to the problem of the aforementioned durability involves a new problem that the manufacturing cost of the door closer is increased.

SUMMARY OF THE INVENTION

Accordingly, it is an object of the invention to provide a door closer high in durability in which the spring constant of a coil spring accommodated in a limited space is minimized, the number of components such as steel shafts and bearings employed in the conventional door closer is minimized, the restoring force is relatively increased when the door opening degree is small and is not increased so much when the door is widely opened, and a locking means such as a latch is positively operated when the door is closed, whereby the door can be smoothly opened and closed.

Another object of the invention is to provide a door closer in which a preset torque can be readily set, and the mounting of the door closer can be readily achieved.

A further object of the invention is to provide a door closer which is of a dividable structure so as to accept and overcome a mounting error which may caused when the door closer is mounted on a pillar and a door.

The novel features which are considered characteristic of this invention are set out in the appended claims. The invention itself, however, together with additional objects and advantages thereof will be best understood from the following detailed description taken in conjunction with the accompanying drawings which illustrate, by way of example only, a preferred embodiment of this invention.

BRIEF DESCRIPTION OF THE DRAWINGS

In the accompanying drawings:

FIG. 6(A) is a plan view illustrating the door closer from which a cap is removed, and FIGS. 6(B) through 6(F) are horizontal sectional views taken along line C—C in FIG. 3 similarly as in FIG. 5;

DETAILED DESCRIPTION OF THE INVENTION

Figure 2:
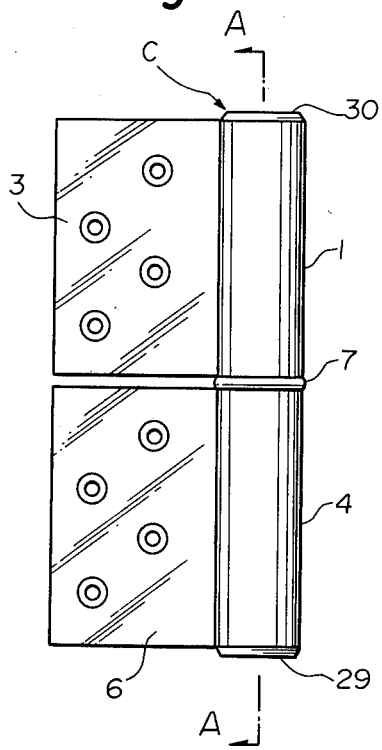
FIG. 2 is a front view showing one example of a door closer according to this invention.
Figure 1:
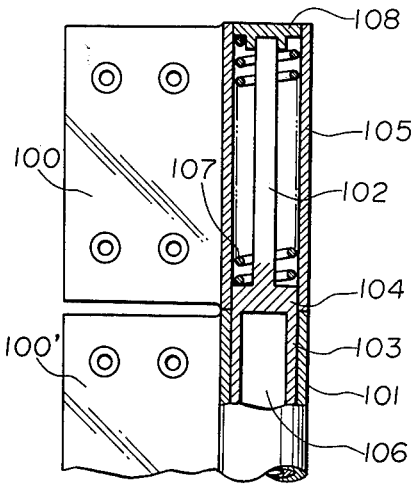
FIG. 1 is a vertical sectional view showing a conventional door closer.
Figure 5:
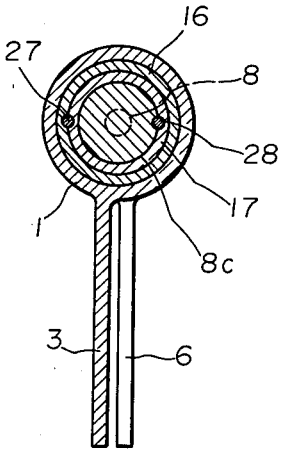
FIG. 5 is a horizontal sectional view taken along line C—C in FIG. 3.

FIGS. 2 through 7 show one embodiment of this invention.

In the door closer according to this invention, a first hinge piece 3 is formed integrally with a first cylinder 1, extending sideward from the latter 1, while a second hinge piece 6 is formed integrally with a second cylinder 4, extending sideward from the latter 4. The first hinge piece 3 is employed to secure the first cylinder 1 to a door 2, while the second hinge piece 6 is employed to secure the second cylinder 4 to a fixing member 5 such as a door frame. The lower end of one of the two cylinders is detachably in contact with the upper end of the other through a rotary support member such as a steel ball so that the two cylinders 1 and 4 are rotatable around one and the same axis with respect to each other.

A support shaft 8 is inserted into the two cylinders 1 and 4 along the central axis thereof, and is surrounded by a coil spring 9. A disk-shaped support shaft fixing piece 13 is fixedly fitted into the lower end portion of the second cylinder. The support shaft fixing piece has a through-hole 11 at the center into which a spring fixing piece 10 having a substantially "U"-shaped section is fitted by caulking, and a serration 13' on the outer wall. The lower end portion 9a of the spring 9 is inserted into the mounting opening 10a of the spring fixing piece 10. The lower end portion 8a of the support shaft 8 is inserted into the through-hole 11 of the support shaft fixing piece 13. The insertion section of the through-hole 11 through which the support shaft 8 is inserted is so shaped as to have two parallel surfaces 14 and 14' so that the support shaft 8 is not turned with respect to the support shaft fixing piece 13. The top end of the lower end portion 8a of the support shaft 8 is protruded downward from the support shaft fixing piece 13. The protruded portion is threaded so that a nut 15 is engaged therewith. As the door closer is constructed as described above, the lower end portion 9a of the coil spring 9 and the support shaft 8 cannot be turned with respect to the second cylinder 4.

On the other hand, in the upper end portion of the first cylinder 1, a bush 16 having a serration 16' on the outer wall is fixedly fitted into the first cylinder 1. An intermediate rotary cylinder member 17 is placed rotatably with respect to the first cylinder and coaxially with the latter. The rotary cylinder member 17 consists of a cylinder portion 17a whose outside diameter is substantially equal to the inside diameter of the bush 16 and a cylinder portion 17b whose outside diameter is slightly smaller than the inside diameter of the coil spring 9. A suport shaft inserting hole 18 is formed in the intermediately rotary cylinder member 17 in such a manner that it penetrates the latter along the axis thereof. The upper end portion 8b of the support shaft 8 is inserted into this support shaft inserting hole 18 so as to be rotatable with respect to the intermediate rotary cylinder member 17. The upper end portion 8b of the support shaft thus inserted is provided with a flange 8c, while a receiving hole whose dimension are substantially equal to the outside diameter and thickness of the flange 8c is formed in the upper end portion of the cylinder portion 17a of the intermediate rotary cylinder member 17. Similarly as in the above case, the flange 8c is rotatably received in the receiving hole 19. The upper surface 8d of the flange 8c is flush with the upper end surface 17c of the intermediate rotary cylinder member 17. A cut section 20 is formed in the cylinder portion 17b of the intermediate rotary cylinder member 17, extending from the lower end of the cylinder portion 17b to near the lower edge of the cylinder portion 17a. The upper end portion 9b of the coil spring 9 is inserted into this cut section 20.

FIGS. 2 through 6 shows the door closer according to this invention which is applied to a door which is opened rightward for instance. A groove 21 having a predetermined length and a semi-circular section whose radius is $r_1$ is formed in the outer wall of the bush 16 fixedly engaged with the upper end portion of the first cylinder, the outer wall of the bush 16 being located at the left of the first hinge piece 3 or in a direction perpendicular to the direction of the first hinge piece 3. In addition, grooves 22 and 23 are formed at the opposed positions of the outer wall and inner wall of the cylinder portion 17a of the intermediate rotary cylinder member 17, respectively. The configuration and radius of each of the grooves 22 and 23 are equal to those of the aforementioned groove 21. Furthermore, a similar groove is formed in the flange 8c formed at the end portion 8b of the support shaft 8. The positions of these grooves 21, 22, 23 and 24 will be described.

Figure 3:
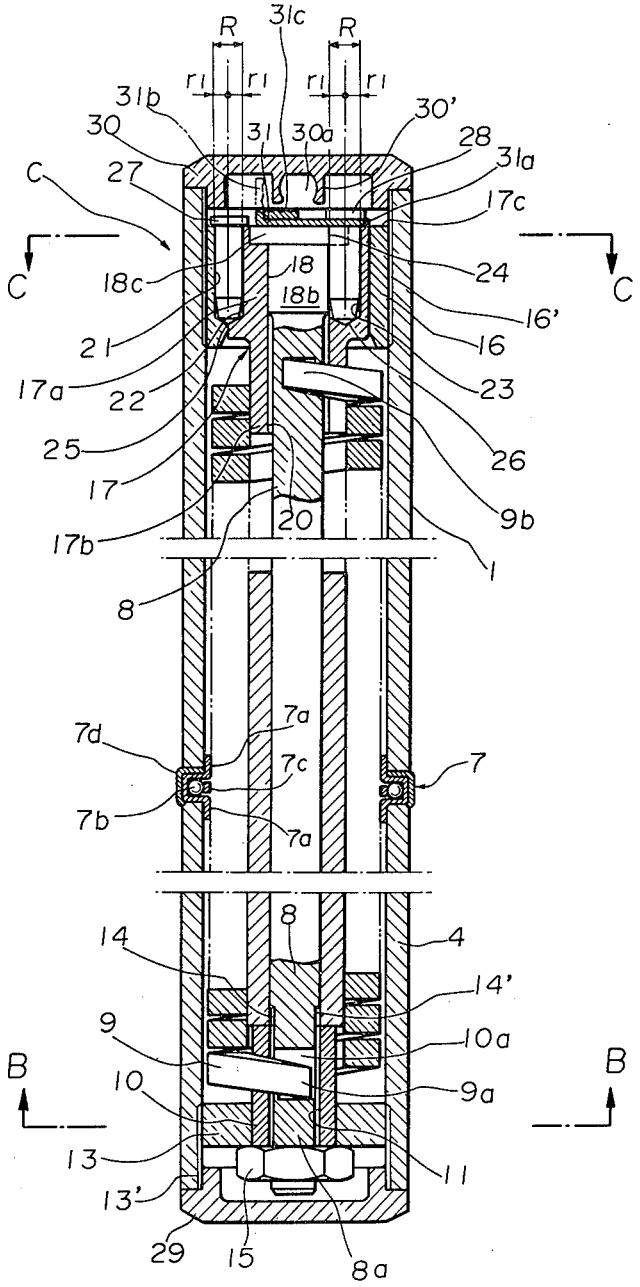
FIG. 3 is a vertical sectional view taken along line A—A in FIG. 2, showing the example of the door closer according to the invention.
Figure 6B:
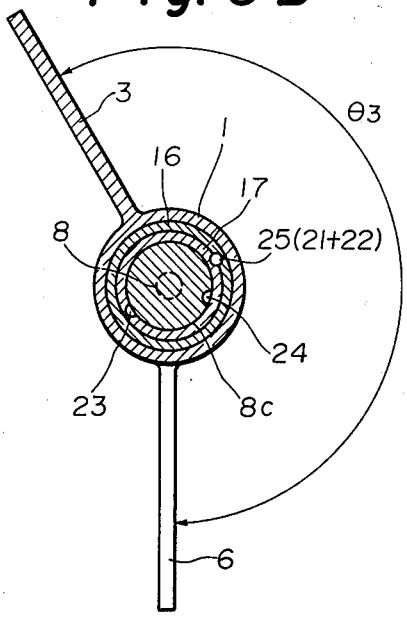
FIGS. 6(A) through 6(F) are diagrams for a description of the steps of the preset work and mounting work of the door closer according to the invention. More specifically.
Figure 6A:
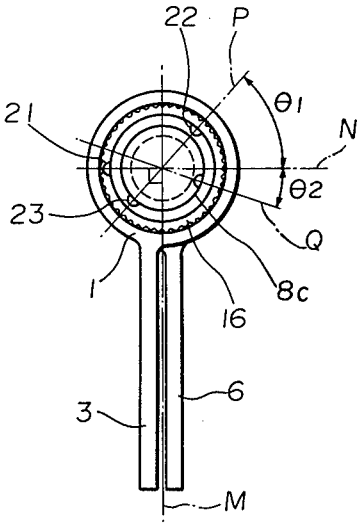
Figure 6D:
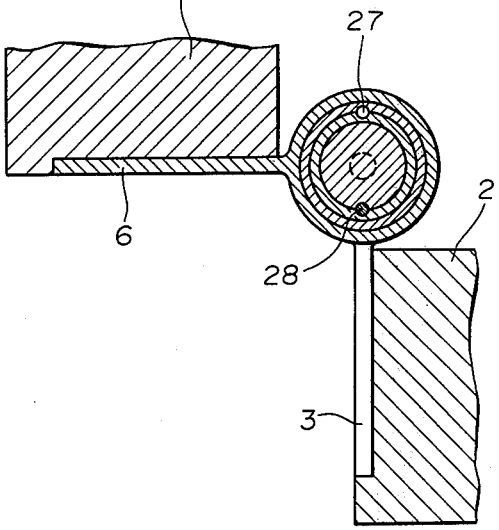

Under the conditions that as shown in FIG. 3, the opening 10a of the spring fixing piece 10 having a substantially "U"-shaped section secured to the support shaft fixing piece 13 is positioned as shown in the figure and the lower end portion 9a of the spring 9 is inserted in this opening 10a, when the upper end portion 9b of the spring 9 is abutted against of the cut section 20 of the cylinder portion 17b of the intermediate rotary cylinder member 17 so that a torque is immediately applied to the spring 9, then the aforementioned grooves 21, 22, 23 and 24 are arranged as shown in FIG. 6(A). More specifically, if the first hinge piece 3 of the first cylinder 1 and the second hinge piece 6 of the second cylinder 6 are arranged in parallel to the center line M passing through the center O of the first cylinder 1, the groove 21 formed in the bush 16 is arranged so that the center of the groove 21 is at the left position on another center line N perpendicular to the line M, while the grooves 22 and 23 are arranged so that the centers of the grooves 22 and 23 formed in the intermediate rotary cylinder member 17 are on a center line P forming an angle $\theta_1 = 45°$ with the center line N, and in addition the groove 24 formed in the flange 8c of the upper end portion 8b of the support shaft 8 is arranged so that the center thereof is on a center line Q forming an angle $\theta_2 = 30°$ with the center line N.

The groove 21 thus arranged at the position confronts the groove 22 of the intermediate rotary cylinder member 17 by rotation of the first cylinder, the grooves 23 and 22 are at the opposed positions, the intermediate rotary cylinder member 17 is rotatable with respect to the first cylinder 1 with the cut section 20 of its cylinder portion 17*b* engaged with the upper end portion 9*b* of the coil spring 9, and both the flange 8*c* integrally formed with the upper end portion 8*b* of the support shaft 8 and the lower end portion 8*a* of the support shaft 8 is not rotatable with respect to the second cylinder 4. Therefore, the groove 23 is confronted with the groove 24 as the groove 22 is rotatably moved. When these grooves 21 and 22, and 23 and 24 in such a positional relation as described above are confronted with one another, two holes 25 and 26 each having a diameter $R = r_1 + r_1$ ($r_1$ being the radius of each groove) are formed. Connecting pins 27 and 28 are provided in advance which are to be inserted, as first and second pins, into the aforementioned holes 25 and 26 in mounting the door closer. In general, as shown in FIGS. 2 and 3, the lower cap 29 and the upper cap 30 made of synthetic resin or the like are placed on the upper surface of the first cylinder 1 and the lower surface of the second cylinder 4, respectively. A holding groove 30*a* is formed in the central portion of the inner wall of the upper cap 30. This holding groove 30*a* is to store one of the aforementioned connecting pins 27 and 28. The holding groove 30*a* comprises protruded pieces 30' and 30' which are capable of holding the connecting pin. The connecting pin 27 or 28 held in the holding groove 30*a* is so shaped that it is substantially cylindrical with a head and its end portion is conical. Furthermore, in order that one of the connecting pins 27 and 28 clamped by the protruded pieces 30' and 30' can be readily pulled out preventing it from being dropped or lost or it is pulled out of the two holes 25 and 26 formed by the aforementioned grooves 21 through 24, a withdrawal piece 31 made of synthetic resin is provided separately. The withdrawal piece 31 has a hole 31*a* whose diameteer is equal to that of the cylindrical portion of the connecting pin, at one end and a serration 31*b* at the other end. If the folding portion 31*c* of the withdrawal piece 31 is pulled out, the connecting pin engaged with the hole of the withdrawal piece 31 can be readily pulled out without dropping it.

The rotary support member 7 provided so that the first and second cylinders are in contact with each other and are rotatable with respect to each other is a sort of thrust bearing which comprises an inner race 7*a*, and steel balls 7*b* rotatably inserted therein as shown in FIG. 3, and further comprises a retainer 7*c* and an outer race 7*d* holding the steel balls 7*b* (shown in FIG. 6).

A sleeve 32 made of material such as polyvinyl or the like is arranged in the clearance between the support shaft 8 and the coil spring 9 over the range of from the first cylinder 1 to the second cylinder 4. The lower end of the sleeve 32 is placed on the upper end of the spring fixing piece. This sleeve 32 contributes to the stabilization of the coil spring 9 in the two cylinders 1 and 4. When the center line of the first cylinder 1 is not coincident with that of the second cylinder 4 because of the hinge piece mounting error or the variation with time, a bending stress is applied to the two cylinders 1 and 4. This non-coincidence of the centerlines of the two cylinders can be prevented by the provision of the sleeve 32. In this example, even in the case when, for instance, a bending stress acts, as a tensile stress, on the support shaft, the above-described sleeve 32 serves so as to make the center lines of the two cylinders 1 and 4 coincident with each other. Therefore, the support shaft 8 can be made thinner; that is, it can be made of a thin rod which is strong against a tensile stress. Accordingly, the cost of material can be reduced. If the support shaft 8 is thin, a certain degree of stress caused when it is bent can be absorbed by itself. Thus, even if such a door closer mounting error is caused which may cause the non-coincidence, or deviation, in the alignment of the center lines of the two cylinders, it is released and the door closer can be satisfactorily used in practice.

The conditions of the door closer C when it is mounted on the door 2 and the door fixing member 5 such as a door frame will be described with reference to FIGS. 6(A) through 6(D) in the stated order.

Figure 4:
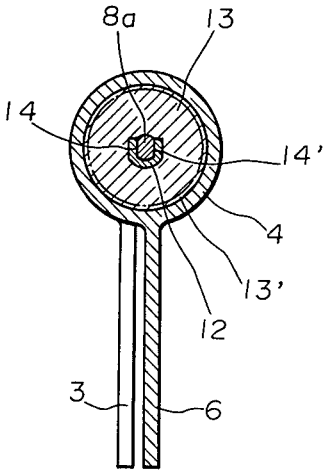
FIG. 4 is a horizontal sectional view taken along line B—B in FIG. 3.

As shown in FIGS. 3 and 4, the lower end portion 8*a* of the support shaft is fixed with the nut 15, and the parallel surfaces 14 and 14' of the lower end portion 8*a* are positioned as shown in FIG. 4. In addition, the first and second cylinders 1 and 4 are positioned as shown in FIG. 6(A). Under these conditions, the intermediate rotary cylinder member 17 connected to the upper end of the spring 9 is rotatable in the cut section 20 of the intermediate rotary cylinder member 17 with respect to the first cylinder 1 and the support shaft 8. Accordingly, the coil spring 9 is maintained free or in a no-load state, and is therefore substantially rotatable with respect to the first and second cylinders 1 and 4. If the second cylinder 4 is turned with respect to the first cylinder 1, then the position of the groove 21 formed in the bush 16 fixed to the first cylinder 1 is changed.

It is assumed that the coil spring 9 is wound in the direction of a left-handed screw and the door 2 is opened by swinging it clockwise as viewed in the figure. In addition, the position where the second hinge piece 6 secured to the door fixing member 5 and the first hinge piece 3 secured to the door are placed one on another will be referred to as "a set position" where the door is closed. Furthermore, the position of the first hinge piece 3 obtained by turning the latter counterclockwise from the aforementioned set position will be referred to as "a spring winding start position"; in other words, the position where the center position of the aforementioned groove 21 as coincident with that of the groove 22 formed in the outer wall of the intermediate rotary cylinder member 17 by turning the first hinge piece 3 under the no-load and free conditions as described above will be referred to as "a preset position." When at this position the first hinge piece is stopped and the hole 25 is constituted by the grooves 21 and 22 as shown in FIG. 6(B), the first pin 27 provided in advance is inserted into the hole 25. As a result, the upper end portion 9*b* of the spring 9 is coupled to the second cylinder 4 through the intermediate rotary cylinder member 17 and the first pin 27 thus inserted. In this case, the torque of the spring 9 acts on the intermediate rotary cylinder member 17 through the first pin 27.

Figure 6C:
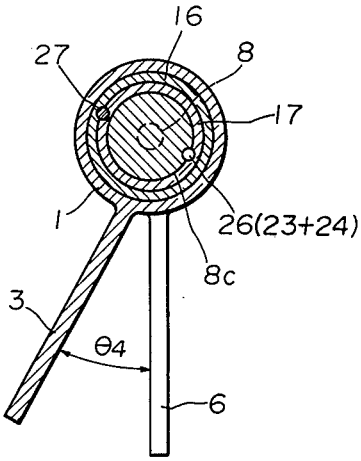

Then, the first hinge piece 3 is turned clockwise with respect to the second hinge piece 6 against the elastic force of the spring 9, and is stopped at the position shown in FIG. 6(C). In other words, the intermediate rotary cylinder member 17 is turned by the first pin 27 inserted into the hole 25 as the first cylinder 1 is turned, and the center of the groove 23 opposite the groove 22 formed in the inner wall of the intermediately rotary cylinder member 17 coincides with the center of the groove 24 formed in the flange 8*c* of the support shaft 8 thereby to provide the hole 26, into which the second pin 28 is inserted. In this operation, the first cylinder 1 is turned through an angle $\theta_3$ clockwise with respect to the second cylinder 4, as a result of which the spring 9 is wound in the direction of a right-handed screw and an elastic force corresponding to the angle $\theta_3$ is stored in the spring 9. This elastic force is a preset torque described later. As a result, the upper end portion of the spring 9 is coupled to the upper end portion 8*b* of the support shaft 8 through the intermediate rotary cylinder member 17 and the second pin 28 thus inserted, and the preset torque acts on the upper and lower ends of the support shaft. In FIG. 6(C), reference character $\theta_4$ is intended to designate an angle caused by the play of the upper end portion 9*b* of the spring 9 which corresponds to the cut width of the cut section formed in the intermediate rotary cylinder member 17.

When, under the condition that the preset torque acts on the upper and lower ends of the support shaft 8 as was described above, the first hinge piece is swung back through the angle $\theta_4$, the preset torque acts completely on the upper and lower ends of the support shaft 8. In this case, the first pin 27 inserted can be readily pulled out. On the other hand, the first and second cylinders 1 and 4 become rotatable substantially without resistance, and the second pin 28 cannot be pulled out. In other words, the first hinge piece 3 and the second hinge piece 6 can be rotated freely. Accordingly, under this condition, the first hinge piece 3 and the second hinge piece 6 are mutually turned to form an angle most suitable for mounting the door closer, and the first and second hinge pieces 3, 6 are secured to the door 2 and the end surface of the fixing member 5 such as a door frame, respectively.

Figure 6F:
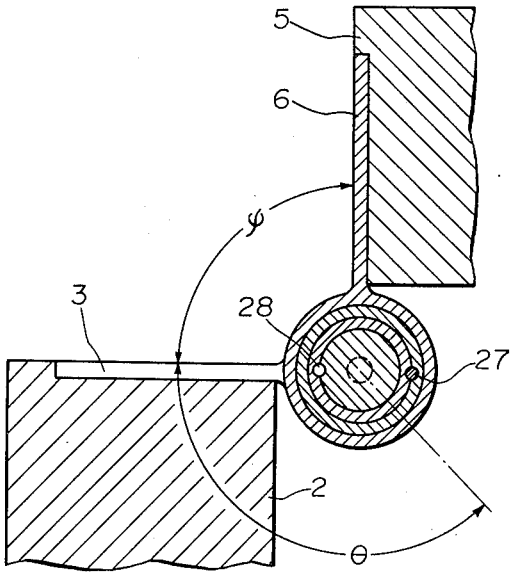
Figure 6E:
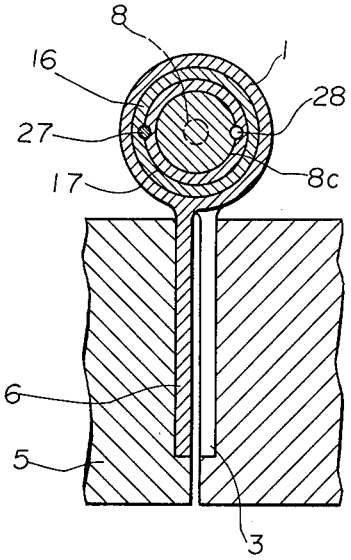

After the door closer is mounted in this way, the door 2 is closed as shown in FIG. 6(E). Thereafter, the inserted second pin 28 is pulled out of the hole 26 while the door 2 being held against the present torque applied to the door 2. Under this condition, the upper end portion 9*b* of the spring 9 is coupled to the intermediate rotary cylinder member 17 and the first cylinder 1, while the lower end portion 9*a* of the spring 9 is coupled to the second cylinder 4, and accordingly the preset torque of the spring 9 is applied to the two cylinders 1 and 4.

Thereafter, the door 2 is opened as shown in FIG. 6(F), and then a torque of the spring 9 corresponding to the sum $(\theta_3 + \phi)$ of the door opening angle $\phi$ and the preset angle $\theta_3$ is applied to the door 2. Therefore, it is apparent that the presetting work and the mounting work has been completed in the state shown in FIG. 6(E).

In the embodiment described above, the flange 8*c* of the support shaft 8 is incorporated in the cylinder portion 17*a* of the intermediate rotary cylinder member 17 so as to rotatably retaining the upper portion of the intermediate rotary cylinder, and therefore it is connected so as to depress the first cylinder from above during the use. On the other hand, the lower end portion 8*a* of the support shaft 8 is fixedly secured to the spring fixing piece 10 by means of the nut 15, and the spring fixing piece 10 is fixed to the support shaft fixing piece 13 by caulking, and in addition the support shaft fixing piece 13 is fixedly secured to the second cylinder 2. Therefore, the lower end portion 8*a* of the support shaft 8 is maintained coupled to the second cylinder 4 at all times. Accordingly, the support shaft 8 serves to retain the upper and lower ends of the two cylinders 1 and 4 so that the two cylinders are not moved apart from each other.

Figure 8:
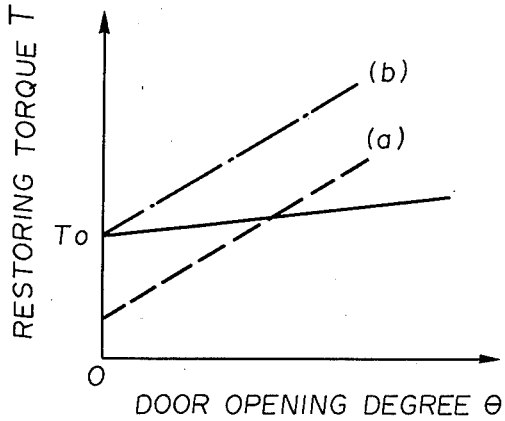
FIG. 8 is a theoretical explanation graph showing the restoring torque of the door closer with respect to the door opening degree.
Figure 7:
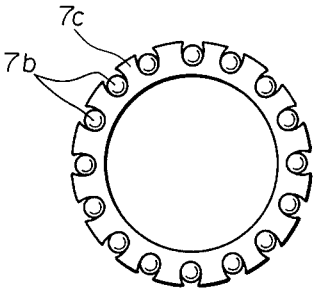
FIG. 7 is a plan view showing steel balls and a retainer constituting a rotary support member employed in the door closer according to the invention.

In the door closer according to this invention, the coil spring 9 can utilize the space defined by the first and second cylinders 1 and 4 substantially over the entire length of the door closer, and therefore the coil spring is long, and accordingly the spring constant, as a torsion spring, of the coil spring 9 is small. Therefore, when the door is opened, the restoring torque of the coil spring 9 does not increase abruptly. More specifically, as shown in the graphical representation in FIG. 8, under the condition that a preset torque $T_o$ is applied to the door closer a suitable initial torque of the door is applied at the time when the opening of the door is started; however, even if the door opening degree $\theta$ is increased, the increase of the aforementioned restoring torque T is not so much. In other words, it is possible to increase the initial torque so that the door locking means such as a latch operates positively when the door is completely closed, and in addition it is possible to suppress the increase of the restoring torque when the door is widely opened, thereby to carry out the opening and closing operation of the door smoothly.

Incidentally, in the structure of the conventional door closer, the support shaft protruded from one of the two cylinders is inserted into the hole of the other cylinder. Therefore, if the mounting error is caused, the center lines of the two cylinders are not in alignment with each other, and accordingly the support shaft of the one cylinder cannot be inserted into the hole of the other cylinder. Thus, it is absolutely necessary to carry out the door and hinge mounting work with a great care and with high accuracy. At worst, it is necessary to reinstall the installed door or hinge to correct the mounting error.

However, with the structure according to this invention including the function of the sleeve 32, all of the above-described drawbacks accompanying the conventional door closer are eliminated. Therefore, it is one of the practical effects of the invention that the mounting work can be readily achieved. Furthermore, as is apparent from the above description, as the door closer according to this invention can be so set that no torque is applied to the hinge pieces during the mounting work, the mounting work can be readily and efficiently carried out, and the door locking means such as a latch can be positively operated by the preset torque. In addition, even in the case where the preset torque is applied, the door closer according to the invention can be so set that the preset torque is not applied to the hinge pieces during the mounting work, and therefore it is another effect of the invention that both the simplification of the mounting work and the application of the preset torque can be obtained simultaneously. The door closer according to this invention is so designed in construction that the number of components such as a steel shaft and a bearing is reduced as much as possible and the spring constant of the coil spring incorporated in a limited space is minimized when compared with those of the conventional door closer. For instance, the restoring torque is applied to the support shaft for only the period of from the presetting operation to the mounting work, and therefore the support shaft has a high durability. As the support shaft is made to be thinner, the support shaft is light in weight and low in cost, and yet the door closer whose durability is completely complemented by the entire structure thereof can be manufactured according to the invention. These merits should be highly appreciated.

What is claimed is:

1. A door closer which comprises:

two hollow cylinders formed integrally with hinge pieces, respectively, said two cylinders being adjacent to each other in the axial direction thereof and rotatable with respect to each other around one and the same axis thereof; a support shaft penetrating said two cylinders; a coil spring surrounding said support shaft, said support shaft and coil spring being incorporated in said two cylinders; an intermediate rotary cylinder member provided between one end portion of said support shaft and the inner wall of first cylinder by inserting said one end portion of said support shaft thereinto, said intermediate rotary cylinder member being rotatable with respect to said support shaft and said first cylinder, the other end portion of said support shaft being provided in second cylinder in such a manner that said other end portion of said support shaft is not rotatable therein, one end portion of said coil spring being non-rotatably secured to said intermediate rotary cylinder member placed at the upper end portion of said first cylinder, while the other end portion of said coil spring being non-rotatably secured to the lower end portion of the second cylinder, grooves being formed at predetermined positions on the inner wall of the upper end portion of said first cylinder, the outer wall of the upper end portion of said support shaft, and the inner and outer walls of said intermediate rotary cylinder member, said grooves being rotatably moved so as to form two holes into which two connecting pins are detachably inserted respectively.

2. A door closer as claimed in claim 1, in which a flange is provided on the other end of said support shaft, and said intermediate rotary cylinder member is arranged between said support shaft and said first cylinder in such a manner that the upper surface of said intermediately rotary cylinder member is flush with the upper surface of said flange, and a rectangular cut section elongated longitudinally is formed in a predetermined position of the lower cylinder portion of said intermediate rotary cylinder member.

3. A door closer as claimed in claim 1, in which a disk-shaped support shaft fixing piece provided with a support shaft inserting hole is fitted into the lower end portion of said second cylinder, and a spring fixing piece whose section is substantially "U"-shaped is inserted into said support shaft inserting hole, and in which the lower end portion of said support shaft is protruded into said support shaft inserting hole, the lower end portion of said support shaft thus protruded being threaded so as to be fixed with a nut.

4. A door closer as claimed in claim 1, in which one end portion of said coil spring surrounding said support shaft which penetrates said first and second cylinders provided with said hinge pieces is engaged with said cut section of said intermediate rotary cylinder member, and the other end portion thereof is engaged with said spring fixing piece.

5. A door closer as claimed in claim 4, in which a sleeve made of material such as polyethylene or polyvinyl is inserted into the clearance between said support shaft and said coil spring.

6. A door closer as claimed in claim 1, in which said first and second cylinders provided with said hinge pieces are detachably provided, and a thrust bearing as a rotary support member is provided between said first and second cylinders so that said first and second cylinders can be rotatable with respect to each other.

7. A door closer as claimed in claim 1, in which caps are placed on the upper end of said first cylinder and the lower end of said second cylinder, and a holding groove made up of protruded pieces for holding a connecting pin is provided in the cap placed on the said first cylinder for the purpose of storing said connecting pin.

8. A door closer as claimed in claim 7, in which said cap further includes a withdrawal piece having at one end portion a pin inserting hole whose diameter is equal to the diameter of said connecting pin and at the other portion a serration, so that said connecting pin can be readily pulled out during the door closer mounting operation.

* * * * *

UNITED STATES PATENT AND TRADEMARK OFFICE

CERTIFICATE OF CORRECTION

PATENT NO. : 4,117,567

DATED : October 3, 1978

INVENTOR(S) : Toyoaki Shimizu

It is certified that error appears in the above-identified patent and that said Letters Patent are hereby corrected as shown below:

Column 4, line 3 "suport" should read --support--.

Column 6, line 45, "as coincident" should read --is coincident--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*